United States Patent [19]

Bonvin

[11] 4,121,689

[45] Oct. 24, 1978

[54] ESCAPE MECHANISM

[76] Inventor: François Bonvin, Rue du Lac 19, 3960 Sierre (Canton of Valais), Switzerland

[21] Appl. No.: 786,964

[22] Filed: Apr. 12, 1977

[51] Int. Cl.[2] ..... A62B 1/00

[52] U.S. Cl. ..... 182/3; 182/82; 187/6

[58] Field of Search ..... 182/3, 5, 19, 82, 100; 188/188, 135, 189; 187/6

[56] References Cited

U.S. PATENT DOCUMENTS

| | | | |
|---|---|---|---|
| 3,200,904 | 8/1965 | Weeks | 182/3 |
| 3,872,949 | 3/1975 | Snyder | 188/189 |
| 3,933,220 | 1/1976 | Swager | 182/3 |

*Primary Examiner*—Reinaldo P. Machado

*Attorney, Agent, or Firm*—Friedman, Goodman & Teitelbaum

[57] ABSTRACT

An escape mechanism for enabling a person to escape at any floor of a building, the escape mechanism including a vertically disposed hollow rail and at least one rack disposed within the rail. At least one running and suspension apparatus is adapted to be introduced within the rail, where the apparatus is equipped with support members and includes an engagement portion having at least one pinion. The pinion engages the rack to allow the apparatus to move along the rail only upon rotation of the pinion. The engagement portion includes impeding assemblies having inertial escapement members for hindering the rotation and for slowing the descent of the apparatus by gravity while the engagement portion is engaged within the rail.

8 Claims, 7 Drawing Figures

Figure 2:
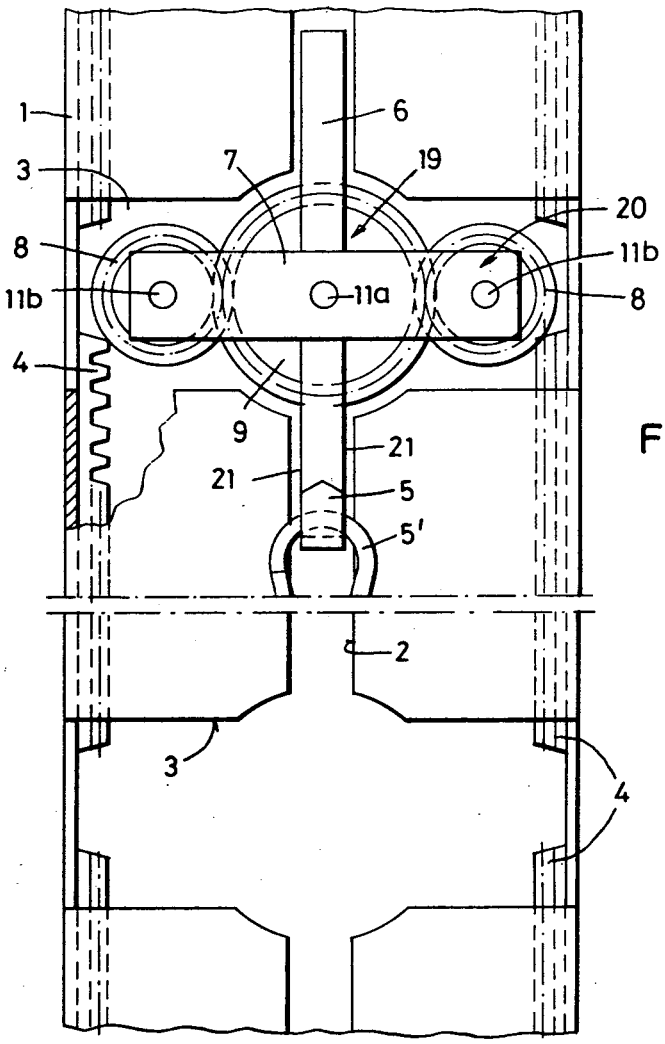

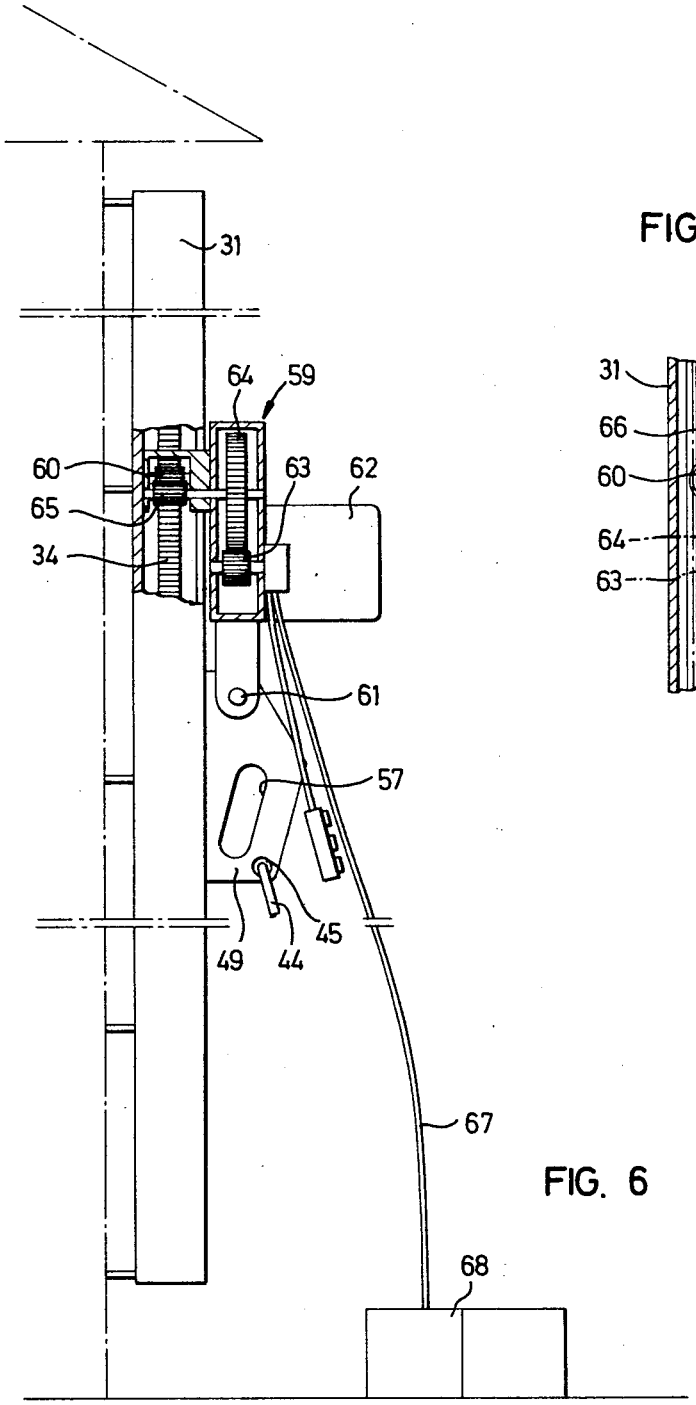
FIG. 6
FIG. 7
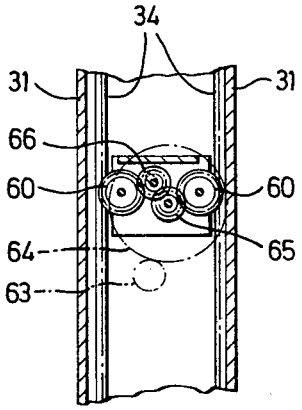

ESCAPE MECHANISM

This invention relates to an escape mechanism for enabling a person in danger at any floor of a building to escape therefrom.

When fire breaks out in a building, it is often impossible for persons on the upper floors to escape by using the stairs; thus it is important for them to have some other possibility of leaving the building by the outside. In certain countries where special ordinances are in effect for that purpose, and in certain modern buildings even in countries having no such special ordinances, provision is frequently made on the outside of buildings for fire-escapes by which it is possible to leave the building in case of emergency. However, besides not being very attractive in most cases, fire-escapes are usually difficult or impossible to install at a subsequent time on older buildings which do not already have them. Moreover, it is often complained that fire-escapes make it too easy for intruders to gain access to offices and dwellings. What is more, they add significantly to the construction costs of new buildings.

It is an object of this invention to provide an escape mechanism which renders just as efficient service as a fire-escape but which has none of the aforementioned drawbacks, i.e., is neither unattractive nor expensive, can be installed subsequently on any existing building, and does not invite intruders.

To this end, the escape mechanism according to the present invention comprises a vertically disposed hollow rail, at least one rack disposed within the rail, and at least one running and suspension apparatus equipped with support means and including an engagement portion comprising at least one pinion and adapted to be introduced within the rail in such a way that the pinion engages the rack for allowing the aforementioned apparatus to move along the rail only upon rotation of the pinion, the engagement portion comprising impeding means having inertial escapement members for hindering that rotation and for slowing the descent by gravity of the apparatus while the engagement portion is engaged within the rail. The hollow rail will preferably be permanently affixed to the face of a building at a location which can be reached by someone vacating the building through any opening on the same floor which may serve as an emergency exit. The support means will be designed to support the body of the person escaping, who will be suspended thereby from the running and suspension apparatus during its descent by gravity.

It is a further object of this invention to provide an escape mechanism, the running and suspension apparatus of which may be stored for many years at the appropriate location on a particular floor awaiting use. If it were necessary to provide for adjusting the apparatus to the weight of each new occupant at the time he moves in—each occupant of each floor having such an apparatus at his disposal—his weight might very well vary over the years, or the spring pressure might change, for certain springs kept permanently under tension tend to yield. Thus it is also necessary to take into account possible changes in parameters which may eventually take place.

More particularly, therefore, it is an object of this invention to provide an improved escape mechanism in which a holding force is operative which increases, virtually quadratically, with the speed of descent, so that the speed of descent varies only within relatively narrow and totally acceptable limits whatever the weight of the person escaping, and so that, the acceleration being automatically eliminated as soon as a predetermined speed is reached, the height from which the apparatus starts down has no effect upon the conditions of use.

Hence in a particularly advantageous embodiment of this invention, the impeding means having inertial escapement members comprise, in cooperation with each pinion, an escapement member which effects an alternating rocking movement and allows the pinion to advance by half a tooth when the escapement member moves in one direction and by half a tooth when it moves in the other direction, each escapement member comprising two backs alternately engaging the teeth of the pinion, these beaks being adapted to receive from the teeth, when the pinion tends to rotate, a mechanical action which continually repels the particular beak engaged, the escapement member being integral with a massive part, the inertia of which opposes the alternating movement of the escapement member and limits the rate thereof as desired in order to keep the speed of rotation of the pinion within a range ensuring that the running and suspension apparatus will take its passenger down safely.

Figure 1:
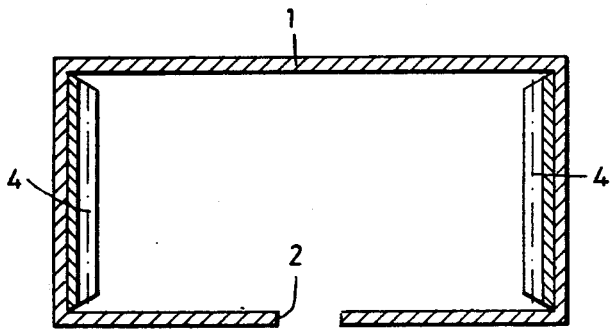
Figure 3:
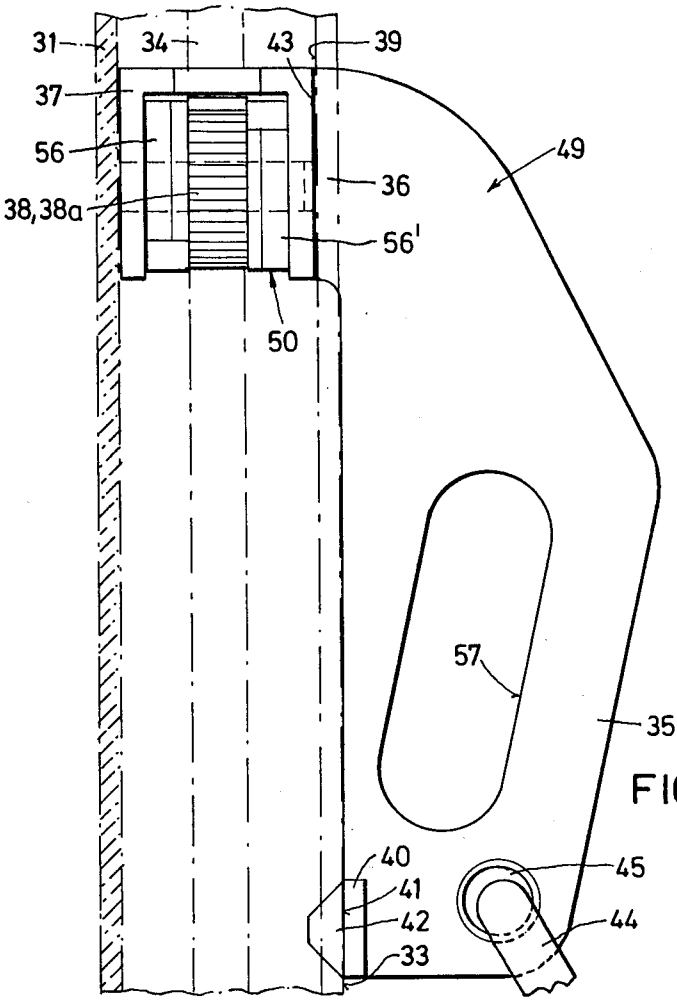
Figure 4:
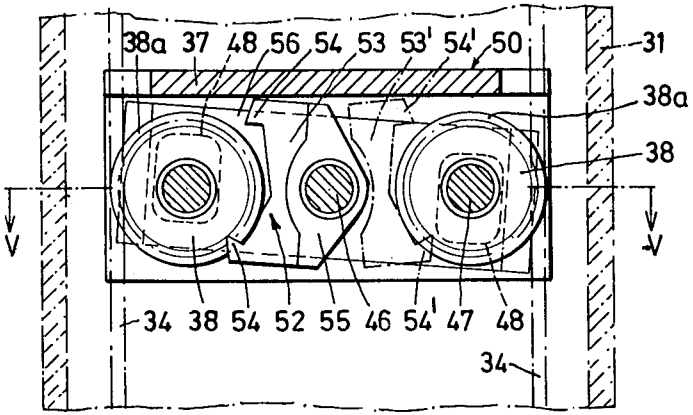
Figure 5:
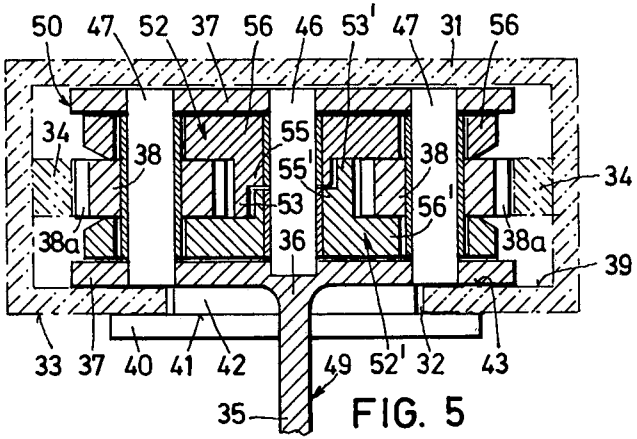

Other objects and advantages of the invention will become apparent from the following detailed description of two preferred embodiments thereof, taken in conjunction with the accompanying drawings, in which:

FIG. 1 is a cross-section through a hollow rail forming part of a first embodiment of the escape mechanism, FIG. 2 is an elevation, partially in vertical section, of the hollow rail of FIG. 1 and of the corresponding running and suspension apparatus, the latter being introduced into the rail through a suitable opening, FIG. 3 is an elevation, partially in section, of an embodiment of the invention provided with improved retaining means, FIG. 4 is a vertical section of the embodiment shown in FIG. 3, part of the running and suspension apparatus and a part forming an escapement member being removed, FIG. 5 is a section taken on the line V—V of FIG. 4, and FIGS. 6 and 7 are elevations, partially in section, of an auxiliary elevator apparatus provided to the escape mechanism.

FIG. 1 shows the C-shaped profile of a rail 1 intended to be fastened vertically along the face of a building by means not shown, preferably spaced from 10 to 20 cm. from the building. Rail 1 comprises a vertical slot 2 and is provided on the inside, within its lateral recesses, with two racks 4. At the level of each floor of the building, the front face of rail 1 has an aperture 3 (FIG. 2) for introducing an engagement portion 20 of a running and suspension apparatus 19. The apparatus 19 also comprises, guided in slot 2, a rod 5 for attachment to a girth or strap 5' (below engagement portion 20) and a coupling protection rod 6 (above engagement portion 20).

Engagement portion 20 of running and suspension apparatus 19 comprises a securing frame 7 which supports pinions 8 rotatable about lateral axles **11*b* and engaging racks 4, as well as two coaxial pinions 9 rotatable about a central axle 11*a* and rotatingly driven by pinions 8, which run on racks 4 when apparatus 19 descends along rail 1**.

It will be clear from FIG. 2 that once engagement portion 20 of apparatus 19 is engaged within rail 1 through an aperture 3, lower and upper rods 5 and 6, respectively, guided by their side surfaces 21 in slot 2, keep engagement portion 20 in a horizontal position, i.e., perpendicular to the longitudinal direction of rail 1, so that pinions 8 necessarily mesh with racks 4 when apparatus 19 descends along rail 1.

FIGS. 1 and 2 having illustrated the basic principle of the mechanism as embodied in the first test prototypes produced in the initial reduction to practice, an embodiment representing a further development, better suited to manufacture on an industrial scale, will now be described with reference to FIGS. 3, 4, and 5; this embodiment, as will be seen, presents particular features of great interest.

In FIGS. 3, 4, and 5, the mechanism will be seen to comprise a rail 31 to be placed against the outside wall of a building at a location which is easily accessible at each floor from a window or balcony. Rail 31 is similar to rail 1 in FIG. 1 but includes, on its front face, a longitudinal slot 32 (corresponding to the opening of the C-profile) which is appreciably wider than slot 2 of the embodiment shown in FIG. 2. The particular functioning of the mechanical arrangement comprised in an engagement portion 50 of the mechanism will be discussed below. First, however, a few exterior features should be noted. Thus, a running and suspension apparatus 49 comprises an intermediate portion 36 which projects from engagement portion 50 through longitudinal slot 32 to form a front portion 35 provided with a grip opening 57 and comprising, at a location situated significantly lower than engagement portion 50, a hole 45 in which a snap-hook 44 engages, to which straps (not shown) enabling a person to hang from apparatus 49 are attached. When the weight of a person is exerted upon the bottom of outer portion 35 of the apparatus, the latter is held in place by pressure of a front face 43 of engagement portion 50 against an inside front wall 39 of rail 31, extending on both sides of slot 32, and by pressure in the other direction of a surface 41 of a lower support portion 40 which presses against an outer front surface 33 of rail 31, beside slot 32. A guide projection 42 extends from surface 41 and enters slot 32 at the level of the bottom of portion 35 of apparatus 49. Thus running and suspension apparatus 49, retained at the top, within rail 31, by its engagement portion 50, is kept by the very weight of the person suspended from it in its operating position as shown in FIG. 3.

The very special design of engagement portion 50 in this embodiment will now be considered. As may be seen from the drawing, this portion 50 comprises a frame 37 of metal plates supporting two pinions 38 at locations which ensure that teeth **38*a* thereof will mesh with racks 34 fixed in rail 31, as racks 4 were fixed in rail 1 of the previous embodiment. It will be particularly evident from FIGS. 4 and 5 that frame 37 is equipped with a central pivot 46, and with two side pivots 47 bearing pinions 38. Pivot 46 bears two escapement assemblies designated as a whole by reference numerals 51 and 52', respectively. In FIG. 4, escapement assembly 52' is assumed to have been removed, only its active escapement portion 53' being shown in dot-dash lines. Escapement assembly 52 comprises an escapement member 53 having two pallets or escapement beaks 54 which engage teeth 38*a* of one of the pinions 38. The other escapement assembly 52' is similarly provided with escapement member 53' having pallets 54', but as mentioned above, assembly 52' is not visible in FIG. 4**.

Each escapement assembly 52, 52' also comprises a bearing portion 55, 55', respectively, by means of which it is independently pivoted on pivot 46. Finally, joined to each escapement member 53, 53' is a massive part 56, 56', respectively, the inertia of which determines the maximum operating rhythm of escapement members 53, 53'.

Massive parts 56 and 56', which are integral with escapement members 53 and 53', respectively, consist of iron plates weighing several hundred grams, or even more than 1 kg., which extend laterally beside the lateral faces of pinions 38. Windows 48, the shape of which is clearly visible in dashed lines in FIG. 4, allow pivots 47 to pass freely whatever the position assumed by massive plate 56 or 56' upon its rocking movement which takes place when the escapement is operating. In FIG. 4, where only massive part 56 is shown, it will be seen that it has assumed its rocked position in which the left-hand end of it is up and the right-hand end down. In this position, the lower pallet or beak 54 engages teeth **38*a*, while the upper pallet or beak 54 is disengaged therefrom. Because of the weight which is pulling apparatus 49 downward, the pinion 38 at the left-hand side of FIG. 4 tends to rotate clockwise, and teeth 38*a* thereof cause escapement assembly 52 to rock so that the left-hand part thereof goes down. When this movement has been accomplished, pinion 38 can advance by half a tooth, and the pallet 54 which is uppermost in FIG. 4 will come into engagement with teeth 38*a*. In order that apparatus 49 may descend at a suitable speed, pinions 38 must rotate relatively fast, and escapement assemblies 52 and 52', with their massive parts 56 and 56', must effect an alternating movement at a rather high frequency. The inertia of massive plates 56 and 56' allows this back-and-forth movement at a certain rhythm only if a fairly great force is exerted upon pallets 54 and 54'**, respectively.

If the rate of descent is multiplied in a certain ratio, the rate of movement of parts 56 and 56' will increase in the same ratio, and the period of time during which these parts will have to accelerate and then decelerate will be reduced in this same ratio, which means that the acceleration communicated to massive parts 56 and 56' will be multiplied as the square of that ratio. This increase in speed in a certain ratio will thus call for an increase in the work force corresponding to the square of this ratio. It will be noted that the kinetic energy is absorbed by successive shocks.

This quadratic increase of the force as a function of the speed is very advantageous, for assuming that the apparatus is designed for a person weighing 60 kg. to descend at the rate of 50 cm./sec, a person weighing 100 kg. will descend with this same apparatus at a rate of about 65 cm./sec., and a person weighing 30 kg. at approximately 35 cm./sec. As the slowest of these three speeds is still quite sufficient for a descent, and as the fastest of them is still not by any means dangerous, the apparatus of this embodiment needs no adaptation to the weight of persons who might have to use it. Moreover, for a descent from a higher floor, once a speed has been attained at which retention by the inertia of massive parts 56 and 56' compensates for the weight of the person suspended from the apparatus, there is no longer any acceleration, and the apparatus can therefore operate, without the need for any particular adjustment, at any rail level at all.

Another significant particularity of this embodiment is that engagement portion 50, of oblong shape and disposed perpendicular to the length of rail 31, is equal in width (measured in the direction of the height of the rail in the position illustrated in FIG. 4) to slot 32 (FIG. 5), so that apparatus 49 may be inserted in rail 31 at any level, engagement portion 50 first being disposed vertically, so that it can be inserted through slot 32, then the entire apparatus 49 being rotated by 90° until guide projection 42 enters slot 32 and remains engaged there under the effect of the weight of apparatus 49 and of the person suspended therefrom. Since apparatus 49 is thereafter kept in the position shown in FIGS. 4 and 5, there is no risk whatsoever that pinions 38 can disengage from racks 34; in order to disengage them, it would be necessary to pull the bottom of part 35 away from rail 31 to disengage projection 42 from slot 32, then once more to rotate apparatus 49 so that the handle is no longer in front of rail 31. However, such a movement is impossible as long as the weight of a person is being exerted on the bottom of part 35. From this point of view, the mechanism described thus provides complete operating safety together with extreme ease of utilization. There is no need to search for a level at which there is an insertion aperture, as in the case of FIG. 2, in order to fit the engagement portion into the rail, for such insertion and engagement may take place at any point at all along the rail.

One other advantageous accessory has also been conceived and produced, as it is shown in FIGS. 6 and 7 of the accompanying drawings. It is an auxiliary elevator apparatus comprising two further pinions 60 analogous to pinions 38 and intended to be placed just above running and suspension apparatus 49, where it can be mechanically attached to apparatus 49 by means 61. The auxiliary elevator apparatus is equipped with a motor 62 and with kinematic means (63–66) enabling this motor to drive the two further pinions 60 so that the elevator apparatus rises along the rail 31 together with running and suspension apparatus 49 (to which it is attached at 61 and which is always ready to act as a "parachute" if need be, e.g., in case of motor breakdown), and also, of course, together with a person (e.g., a fireman) suspended from apparatus 49 by means of snap-hook 44 and straps.

In an actual reduction to practice, the average speed at which running and suspension apparatus 49 enabled an adult of average weight to descend along the rail was approximately 40 cm. per second; furthermore, by equipping the elevator apparatus with a motor 62 of a non-encumbering size, the possible speed of elevation was approximately 20 to 25 cm./sec.

The motor driving the elevator apparatus will preferably be an electric motor 62 powered by a flexible cable 67 from a power source, if possible a generator 68, on the ground. The use of a generator is preferable since the mains current is usually cut off in the case of a fire, which is a typical instance when the escape mechanism would be used to save people in danger on the upper floors of a building.

It should be noted as well that the escapement unit 38, **38*a*, 53, 54, 53', 54', is far from being friction-free, this depending to a large extent upon the profile of teeth 38*a* and of pallets or beaks 54. The existence of this friction means that even for very slow speeds at which the inertia of massive parts 56 and 56' practically does not enter into consideration, a certain minimum force is necessary to make running and suspension apparatus 49** descend. It is possible to take advantage of this phenomenon by determining the parameters of the escapement in such a way that the resistance due to this friction is very slightly greater than the weight of the running and suspension apparatus, so that once this apparatus has been put in place in the rail, it remains stationary as long as it is subjected only to the effect of its own weight. As soon as even a very light person hangs from the apparatus, however, it will start down. This may prove very convenient in creating favorable departure conditions for anyone using the escape mechanism.

It will be obvious that it is also possible to envisage and produce numerous other embodiments which would still conform to the particular concept of which practical examples have just been described by way of illustration.

What is claimed is:

1. An escape mechanism comprising:

a vertically disposed hollow rail (1; 31), at least one rack (4; 34) disposed within said rail, and at least one running and suspension apparatus (19; 49) equipped with support means (5,5'; 35,44) and including an engagement portion (20; 50) comprising at least one pinion (8; 38) and adapted to be introduced within said rail in such a way that said pinion engages said rack for allowing said apparatus to move along said rail only upon rotation of said pinion, said engagement portion comprising impeding means having inertial escapement members (53,52') for hindering said rotation and for slowing the descent by gravity of said apparatus while said engagement portion is engaged within said rail.

2. The escape mechanism of claim 1, wherein said impeding means (52,52') comprises, in cooperation with said pinion (38), an escapement member (53,54; 53' 54') which effects an alternating rocking movement and allows said pinion to advance by one-half tooth when said escapement member moves in one direction and by one-half tooth when said escapement member moves in the other direction, each said escapement member comprises two beaks (54,54') for alternate engagement with the teeth (**38*a*) of said pinion, said beaks being designed to receive from said teeth, when said pinion rotates, a mechanical action which repulses said beak, thereby actuating said escapement member which is integral with a massive part (56,56'), the inertia of which opposes the alternating movement of said escapement member and limits the rhythm thereof to the desired extent to confine the rotation of said pinion to a range of speed ensuring a safe descent of said apparatus (49**).

3. The escape mechanism of claim 2, wherein said hollow rail (31) has a C-shaped rectangular cross-section (FIG. 6), the opening of said C forming along said rail a slot (32) through which an intermediate portion (36) of said apparatus connects said engagement portion (50) to a grappling portion (35) of said apparatus to which said support means (44) are connected, two said racks (34) being respectively secured facing one another in the two lateral recesses of said C within said hollow rail, and said engagement portion comprising two said pinions (38) respectively engaging said racks and each cooperating with a said escapement member (53, 54; 53', 54').

4. The escape mechanism of claim 3, wherein said engagement portion (50) comprises three parallel axles (46,47), one a central axle (46) and the other two lateral axles (47) situated one on each side of said central axle, said lateral axles respectively bearing said pinions (38)

and said central axle bearing two said escapement members (53,54; 53',54') with said massive parts (56, 56'), said members cooperating respectively with said pinions and pivoting, for their alternating rocking movement, independently of one another on said central axle, and said massive parts consisting of plates made of a metal at least as dense as iron, said plates extending to alongside the lateral faces of said pinions and including apertures (48) positioned and dimensioned for allowing said lateral axles to pass freely in any position assumed by said plates in the course of said alternating movement effected by said plates integrally with said escapement members.

5. The escape mechanism of claim 4, wherein said engagement portion (50) of said apparatus (49) has a generally oblong shape, the length thereof corresponding substantially to the distance separating said two facing racks (34) so that said two pinions (38) mesh with said racks when said engagement portion is disposed in said rail (31) with the length of said oblong shape directed perpendicular to the length of said rail, and the width of said oblong shape being slightly less than the width of said slot (32) so that said engagement protion may be inserted into said rail from outside when the length of said oblong shape is directed parallel to the length of said rail, then rotated by a quarter of a turn with the entire said apparatus (49) in order to come into operating position.

6. The escape mechanism of claim 5, wherein said grappling portion (35) extends perpendicular to the length of said oblong shape of said engagement portion (50), in downward direction relative to the position of said apparatus (49) in operation, said support means (44) being connected to the lower end of said grappling portion, said grappling portion further comprising at said lower end a support portion (40) having a support surface (41) facing said rail (31) and pressing against the two edges (33) of said slot (32), and a guide projection (42) projecting from said support surface and entering said slot for preventing any inopportune swaying movement of said apparatus during operation thereof.

7. The escape mechanism of claim 1, further comprising an auxiliary elevator apparatus (59) designed to be mechanically connected to a said running and suspension apparatus (49) and including an elevator engagement portion equipped with at least one drive pinion (60) meshing with a said rack (34), said drive pinion (60) being driven by a motor (62) in the proper direction for causing a rising movement of said elevator apparatus along said rail (31) together with said running and suspension apparatus (49) and a person suspended therefrom.

8. The escape mechanism of claim 7, wherein said motor is an electric motor (62) powered with electrical energy from a fixed unit (68) via a flexible cable (67) connecting said unit (68) to said auxiliary elevator apparatus (59).

* * * * *